US007802903B1

(12) United States Patent
Wray

(10) Patent No.: US 7,802,903 B1
(45) Date of Patent: Sep. 28, 2010

(54) LED FESTOON LIGHTING

(75) Inventor: Donald Wray, Ocala, FL (US)

(73) Assignee: J&J Electronic, Inc., Irvine, CA (US)

( * ) Notice: Subject to any disclaimer, the term of this patent is extended or adjusted under 35 U.S.C. 154(b) by 56 days.

(21) Appl. No.: 12/135,894

(22) Filed: Jun. 9, 2008

Related U.S. Application Data

(60) Provisional application No. 60/933,779, filed on Jun. 7, 2007.

(51) Int. Cl.
*F21S 4/00* (2006.01)

(52) U.S. Cl. ..... 362/249.02; 362/294

(58) Field of Classification Search ..... 362/249.02, 362/294

See application file for complete search history.

(56) References Cited

U.S. PATENT DOCUMENTS

| | | | | |
|---|---|---|---|---|
| 5,207,503 | A | 5/1993 | McLaughlin | |
| 2005/0258440 | A1 * | 11/2005 | Dry | 257/88 |
| 2007/0057364 | A1 * | 3/2007 | Wang et al. | 257/701 |
| 2007/0076428 | A1 | 4/2007 | Wu | |
| 2007/0139895 | A1 * | 6/2007 | Reis et al. | 361/719 |

* cited by examiner

*Primary Examiner*—David V Bruce
(74) *Attorney, Agent, or Firm*—Robert D. Buyan; Stout, Uxa, Buyan & Mullins

(57) ABSTRACT

Light emitting diode (LED) modules useable in festoon-type lighting applications and lighting systems incorporating such modules. The LED module generally includes a circuit board having one or more LEDs mounted in a heat sink member. Contact members are attached to opposing ends of device. The heat sink is not required to conduct electrical current when the LED(s) is/are illuminated. High powered LEDs (greater than ½ Watt) may be employed.

18 Claims, 2 Drawing Sheets

LED FESTOON LIGHTING

RELATED APPLICATION

This application claims priority to U.S. Provisional Patent Application No. 60/933,779 entitled "LED Festoon Lighting" filed Jun. 7, 2007, the entire disclosure of which is expressly incorporated herein by reference.

FIELD OF THE INVENTION

The present invention relates generally to electrical lighting technology and more particularly to light emitting diode (LED) modules that may be used in festoon lighting applications or other applications.

BACKGROUND OF THE INVENTION

A festoon style lamp is one that is suspended between two points. Typically, festoon lamps have electrical contacts members (e.g., "bases" or "end caps" formed of conductive material such as aluminum or nickel-plated brass) on either end of an elongate cylindrical glass tube. In traditional incandescent festoon lamps, the glass tube is filled with a suitable gas and a filament, typically a tungsten filament, is positioned within the glass tube coincident with its longitudinal axis. The feston lamp is held in place by inseting its electrical contact members into spaced apart contacts that are configured to receive and to energize the lamp.

U.S. Pat. No. 5,207,503 (McLaughlin) describes festoon lamps of the foregoing general character that contain xenon gas. The xenon lamp has cylindrical, conical tipped end caps, a tungsten filament, and a cylindrical bulb. The end caps are made of conductive material such as aluminum or nickel-plated brass, and are designed to adapt the lamp to fit into spade shaped contacts.

United States Patent Application Publication No. 20070076428 (Wu) describes a festoon lamp which comprises a light-permeable tube with two electrode contacts respectively installed at two ends of the light-permeable tube. A light-conducting element is installed inside the light-permeable tube and two light sources are respectively installed at two ends of the light-conducting element and respectively coupled to the two electrode contacts. This lamp is purported to use minimum light sources to obtain a large light-emitting area, thereby reducing power consumption.

In recent years, the use of LED's in various lighting applications has grown. LED's are solid state lamps that use semiconductor material instead of a filament or neon gas. When compared to traditional (i.e., fluorescent or incandescent) light bulbs, LED's offer a number of advantages. For example, because LED's operate on low voltage and consume less power, they are less expensive to operate and generate significantly less heat than traditional light bulbs. Also, because LED's are of solid state design, they are more durable and less likely to break than traditional bulbs. Another advantage of LED's is their long life. Some LED lamps can operate for up to 100,000 hours, compared to about 1500 hours for a standard filament light bulb. Moreover, LED's are environmentally friendly, contain no mercury and produce no electromagnetic emissions. Another advantage is that a single LED bulb can produce many different colors without the need for colored coatings or lenses. In view of their numerous advantages, LED's are being used in many applications where fluorescent or incandescent lighting was previously used. However, because LED's generate substantial amounts of heat, their applications in tradition festoon type lamps has been limited to relatively low output LED's (e.g., less than ½ watt). Others have proposed heat dissipation apparatus for dissipating the heat from LED's in festoon lamps. For example, United States Patent Application Publication No. 20050258440 (Dry) describes light emitting diode (LED) light sources including festoon lamps wherein an LED is carried on a surface of a heat transfer member or heat sink fabricated from aluminum or other material having efficient heat transfer properties. The heat sink is configured to transfer heat from the LED to fluid that is contained by or surrounds the thermally conductive member(s). However, in this system, the heat sink itself is electrically conductive and the end caps or bases of the feston lamp are mounted on the ends of the heat sink. Also, in the examples shown in United States Patent Application Publication No. 20050258440 (Dry), components of the festoon lamp extend upwardly from the circuit board, above the upper edges of the ends caps, thus potentially limiting the ability of the feston lamp to rotate within a confined or enclosed fixture or space.

There remains a need in the art for the development of new festoon type LED lamps having improved heat dissipation capabilities sufficient to enable the use of "power" LEDS of greater than ½ watt and which, in at least some applications, may be powered by alternating current (AC) and which may be configured to have a low profile to allow free rotation of the festoon lamp within a confined or enclosed fixture or space.

SUMMARY OF THE INVENTION

In accordance with the present invention, there is provided an LED module which generally comprises: (A) a circuit board having an upper surface, an undersurface, a first end, a second end and a solid state regulated circuit and a plurality of thermal vias; (B) at least one LED mounted on the circuit board; (C) a first contact member (e.g., a base or end cap) attached to the first end of the circuit board; (D) a second contact member (e.g., a base or end cap) attached to the second end of the circuit board; and (E) a heat sink member affixed to the underside of the circuit board, wherein such heat sink member is not required to conduct electrical current when the LED(s) is/are illuminated. In at least some embodiments of this light emitting diode module, the first and second contact members may be configured for mounting within a festoon type light fixture. Also, in at least some embodiments of this light emitting diode module, the circuit may be capable of operating on AC and may comprises a constant current AC regulation scheme as described more fully below.

Further in accordance with some embodiments of the present invention, there are provided LED modules of the foregoing character having sufficient heat dissipation capabilities to enable their use with one or more light LED's having according to claim 1 wherein said at least one LED comprises at least one light emitting diode having an output in the range of from 25 to about 75 lumens and in some embodiments of at least 35 lumens.

Still further in accordance with some embodiments of the present invention, there are provided LED modules of the foregoing character having sufficient heat dissipation capabilities to enable their use with one or more LED's having a power of more than ½ watt per LED.

Still further in accordance with some embodiments of the present invention, there are provided LED modules of the foregoing character having sufficient efficiency to operate on a total of less than 4 watts of power and in some embodiments less than less than 3 watts of power (e.g., a total of about 2½ watts of power).

Still further in accordance with some embodiments of the present invention, there are provided LED modules of the foregoing character wherein no component of the device extends upwardly above the upper-most points on the first and second contact members. This low profile of the device allows the module to be at least partially rotated or "aimed" in a desired direction while mounted within a confined space or enclosure.

Still further in accordance with some embodiments of the present invention, there are provided festoon light systems which comprise a festoon-type light fixture (e.g., a strip light fixture, string of lights, automotive or marine light fixture, under-cabinet light fixture, etc. having festoon-type contacts for mounting festoon lamps therein) with at least one LED module of the present invention mounted therein.

Further details, aspects, applications, elements and components of the present invention will be readily understood by those of skill in the art upon reading of the detailed description and examples set forth below.

DETAILED DESCRIPTION

The present invention provides improved LED modules that may be used in festoon lighting applications or other applications. Festoon light LED modules of the present invention may have high output LED's (e.g. "power" LED's) such as ½ watt (W) LED's which deliver approximately 25 lumens or more each. Also, festoon light LED modules of the present invention have unique heat dissipating construction which carries heat away and allows for the use of the power LED's in the confined space available within a typical festoon light socket. Also, the festoon light LED modules of the present invention have unique circuitry whereby they utilize constant current AC regulation.

This invention includes novel devices, systems and methods for controlling AC current in a 12 Volt AC LED powered Light bulb replacement for direct fit and cross to incandescent Festoon style lamps. In order to compete with the brightness and color temperature of the incandescent lamps which are used mostly in coves and cabinets and other architectural type of lighting applications where the quality and brightness of the light is an important factor LED's can only perform this if the higher power ½ W or higher LED are used. Due to the power supply being AC and LED's like a constant DC current the problem of driving the LED's and cooling the LED's are major issues because of the small size of the lamp.

Figure 1:
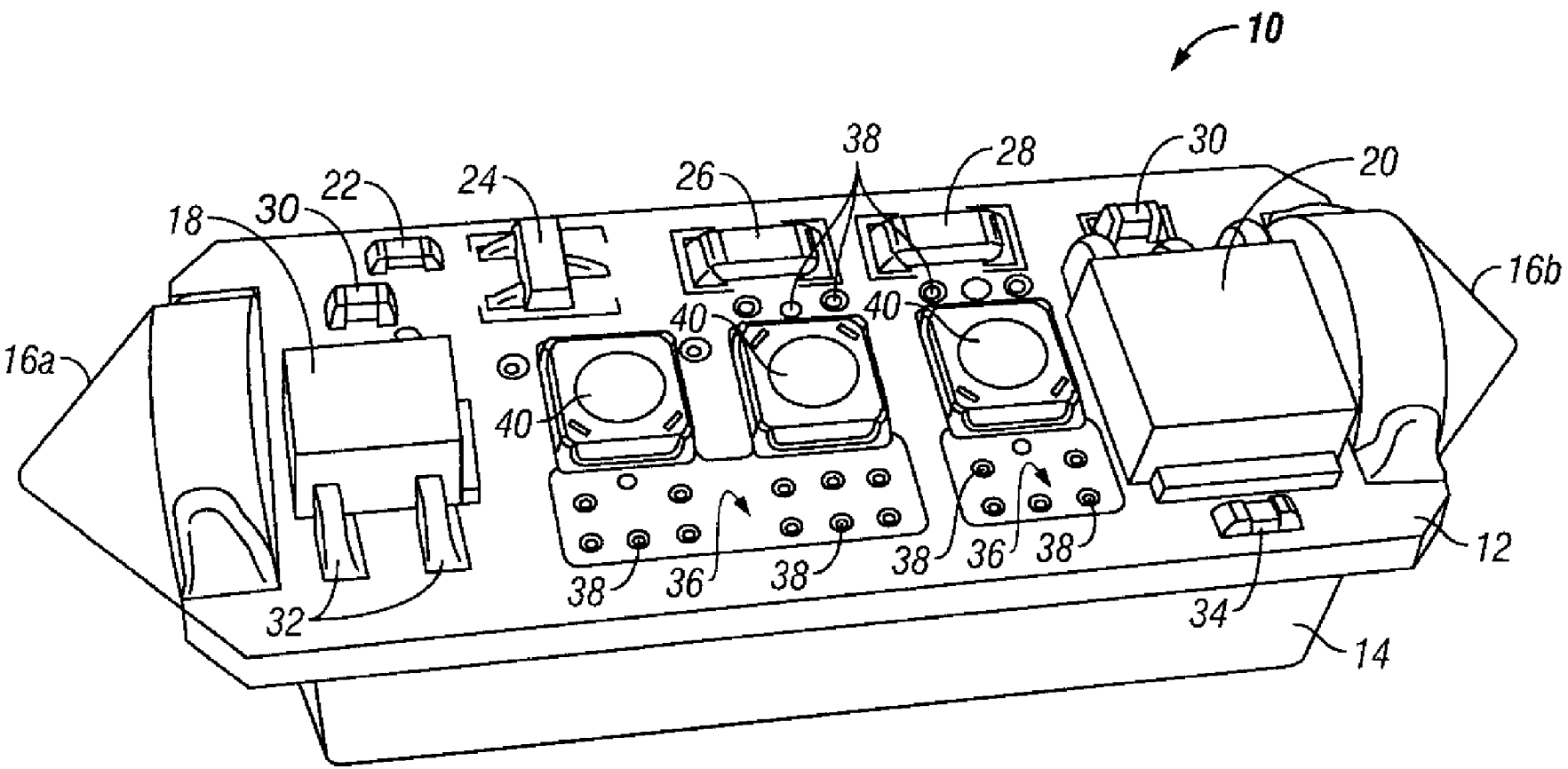
FIG. 1 is a perspective view of an LED festoon lamp of the present invention.
Figure 2:
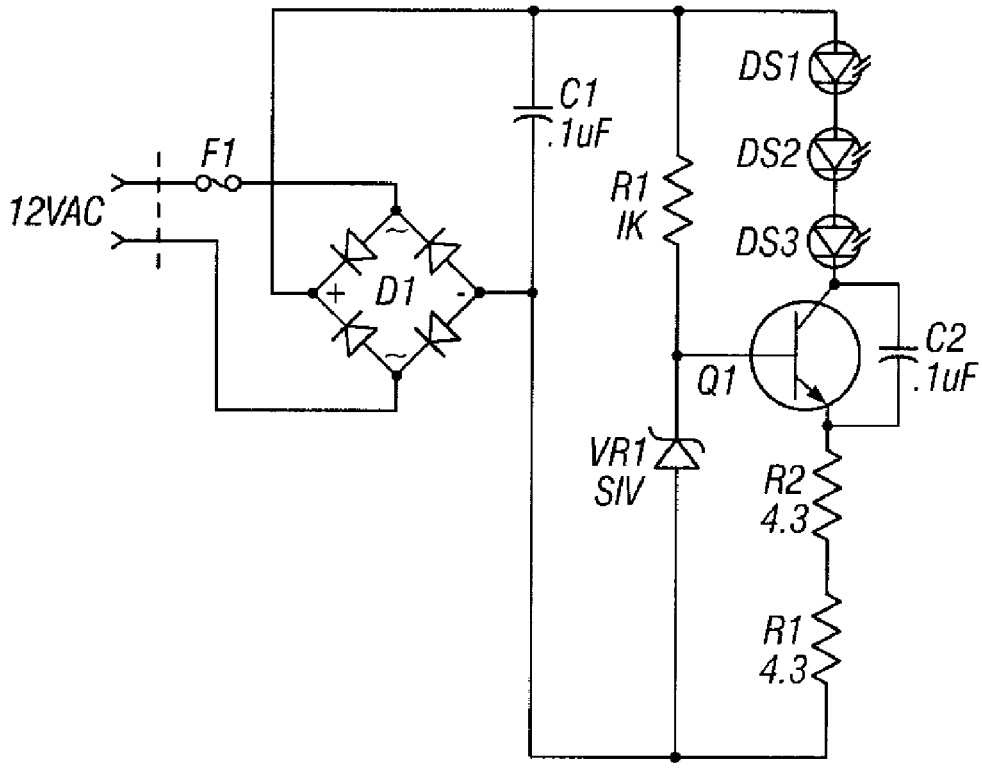
FIG. 2 is an electrical schematic of the LED festoon lamp of FIG. 1.
Figure 3:
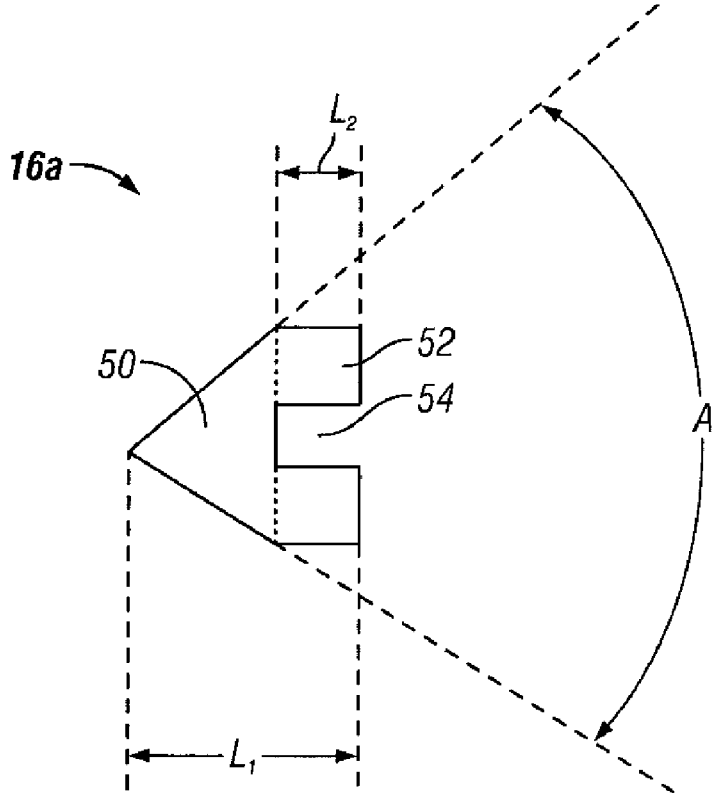
FIG. 3 is an enlarged side view of one of the end caps of the LED festoon lamp of FIG. 1.

FIGS. 1-3 show one example of an LED festoon lamp 10 of the present invention. In this embodiment, the lamp 10 generally comprises an elongate circuit board 12 having an integrated circuit and one or more LEDs 40 mounted on a heat sink member 14 which need not conduct electrical current when the LED(s) is/are illuminated. End caps 16*a*, 16*b* are attached to either end of the circuit board 12. The integrated circuit, which is shown diagramatically in FIG. 2, includes a bridge rectifier 18 (e.g., a 400V, 0.8 A Mini-Dip SMT #HD04 available from Diodes, Inc., Dallas, Tex.), brass terminals 32, a transistor 20 (e.g., NPN Power Transistor SOT223 #BCP56-16TI available from ON Semiconductor Corp., Phoenix, Ariz.), a first resistor 22 to bias voltage (e.g., a 1K Ohm, 1/10 Watt 5% 0603 generic resistor)), a voltage reference 24 (e.g., a 2.5 Volt, SOT-23, #LM4431M3-2.5 generic voltage reference), other resistors 28 & 28 (e.g., 4.3 Ohm, ¼ Watt 1% 1026 generic resistors) and a capacitors 30). Thermally conductive tape and/or thermal epoxy is used to firmly attach the underside of the circuit board 12 to the upper surface of the heat sink 14. In the particular example shown, the heat sink 14 comprises a 5 fin extruded heat sink (1 inch×0.530 inch×0.2 inch) available from Aavid Thermalloy, LLC, Concord, N.H. The heat sink may be formed of any suitable material, such as copper or aluminum.

Thermally conductive areas, such as copper layers 36 may be formed on the circuit board 12 at one or more areas, such as areas adjacent to the LEDs 40, as shown. Thermal vias 38, such as apertures, are formed at a plurality of locations in the circuit board 12 to facilitate passage of heat to the underlying heat sink 14. In the particular example shown, some of the thermal vias 38 are located within areas bearing the thermally conductive copper layers 36.

The contact members 16*a*, 16*b* may be of any suitable configuration and are directly connected to the circuit of the circuit board so as to energize the circuit. In the particular example shown in the figures, each contact member 16*a*, 16*b* comprises a blunt-tipped conical outer portion 50 and a generally cylindrical inner portion 52. In this particular example, the contact members 16*a*, 16*b* have an overall length of about 0.266 inch, the cylindrical inner portion 52 has a length of about 0.100 inch and the generally conical outer portion 50 is tapered at an angle A of about 82 degrees. Cut-out areas 54 are formed in the cylindrical inner portion 52 (see FIG. 3) to facilite its firm mounting on one end of the circuit board 12.

Constant Current AC Regulation

The integrated circuit of the festoon lamp 10 shown in FIGS. 1-3 operates on AC and utilizes full wave rectification of a 12V AC wave form to create peaks of about 16 volts at 120 times a second. This includes the loss of the bridge rectifier. A Schottky rectifier can be used to further increase efficiency. By using the combination of the transistor biased by a voltage reference and an emitter resistance a constant current common emitter circuit is used to control the peak current in the LED's, as soon as their series voltage drop is exceeded. White LEDs have a forward drop of about 3.2V each. For three white LEDs connected in series, the forward drop is about 9.6 Volts. This means that as the voltage of the ½ sinusoidal waveform approaches the 16 volt peak, the LEDs will remain unilluminated until the voltage reaches about 9.6 plus the drop across the transistor and emitter resistor. The transistor 20 and emitter resistor drop are about 1.75 volts at maximum. When the sinusoidal waveform reaches 11.35 Volts, the LED currents will be full on to the predetermined current setting. This circuit is designed to operate the LED's at 50% on 50% off duty cycle at 120 times a second. It is known that the sine of 45 degrees is 0.707 X the peak voltage. This would be 0.707×16 Volts=11.3 Volts. Each 180 degree sinusoidal pulse has the LED on for 90 degrees or +45 degrees thru −45 degrees of the waveform creating a 50% duty cycle. This quasi-regulation is substantially more efficient than a straight resistive load because, once the set LED current is met, the current does not change. The power dissipation on the transistor 20 is linear and is a function of the constant current multiplied by the voltage drop across the transistor 20. Because of the linear power dissipation in the transistor 20, this also aids in lowering the total power dissipation of the lamp 10.

LED Type

Examples of power LEDs 40 that may be incorporated into LED modules 10 of the present invention include the ½ Watt Rigel Series LED available from Nichia Corporation. These LEDs provide a good thermal junction to case, high output and good color binning characteristics. In the festoon lamp 10 example shown in the figures, each module has three (3) of these LEDs in series driven at 250-300 mA at 50% duty cycle.

Thermal Management

Because of the small size of the festoon lamp 10 and its use of power in the 1.7-2.5 W range, the heat sink 14 is used on the back side of the PCB. All of the circuit components are SMT mounted to the topside of the circuit board 12 and the heat sink 14 is mounted to the rear. Thermal conductive tape and or epoxies are used to hold the heat sink in place. In order to conduct the heat out of the LED's and driver transistor thermal plated thru holes under the components connected to pads under the PCB that make contact with the heat sink thru the thermal tape is used to cool the devices. The bridge rectifier is has one of the AC input leads thermally connected to one of the bulbs metal end caps to aid in its cooling. One of the advantages of this bulb design is to lower heating and power consumption over the incandescent lamps.

It is to be appreciated that the invention has been described herein with reference to certain examples or embodiments of the invention but that various additions, deletions, alterations and modifications may be made to those examples and embodiments without departing from the intended spirit and scope of the invention. For example, any element or attribute of one embodiment or example may be incorporated into or used with another embodiment or example, unless to do so would render the embodiment or example unsuitable for its intended use. Also, where steps of a method or process are described in a certain order, the ordering of such steps may be changed unless to do so would render the method or process unsuitable for its intended use. Accordingly, all reasonable additions, deletions, modifications and alterations are to be considered equivalents of the described examples and embodiments and are to be included within the scope of the following claims.

What is claimed is:

1. A light emitting diode module comprising:

a circuit board having an upper surface, an undersurface, a first end, a second end and a solid state regulated circuit comprising an AC regulation scheme and a plurality of thermal vias;

at least one light emitting diode mounted on the circuit board;

a first contact member attached to the first end of the circuit board;

a second contact member attached to the second end of the circuit board; and a heat sink member affixed to the underside of the circuit board, wherein said heat sink member is not required to conduct electrical current when said at least one LED is illuminated.

2. A light emitting diode module according to claim 1 wherein the first and second contact members comprise substantially conical end caps.

3. A light emitting diode module according to claim 1 wherein the first and second contact members are configured for mounting within a festoon type light fixture.

4. A light emitting diode module according to claim 1 wherein said at least one light emitting diode comprises at least one light emitting diode having an output of at least 35 lumens.

5. A light emitting diode module according to claim 1 wherein said at least one light emitting diodes comprises a plurality of light emitting diodes each of which has an output of at least 35 lumens.

6. A light emitting diode module according to claim 1 wherein said at least one light emitting diode comprises at least one light emitting diode having an output in the range of from about 25 to about 75 lumens.

7. A light emitting diode module according to claim 1 wherein said at least one light emitting diodes comprises a plurality of light emitting diodes each of which has an output in the range of from 25 to about 75 lumens.

8. A light emitting diode module according to claim 1 wherein said at least one light emitting diode comprises at least one light emitting diode having a power of at least ½ Watt.

9. A light emitting diode module according to claim 1 wherein said at least one light emitting diodes comprises a plurality of light emitting diodes each of which has a power of at least ½ Watt.

10. A light emitting diode module according to claim 1 further comprising one or more thermally conductive layers on the upper surface of the circuit board.

11. A light emitting diode according to claim 8 wherein at least one thermal via is located within or adjacent to a thermally conductive layer.

12. A light emitting diode module according to claim 1 wherein the heat sink member is formed substantially of copper or aluminum.

13. A light emitting diode module according to claim 1 which operates on a total of less than 4 watts of power.

14. A light emitting diode module according to claim 1 which operates on a total of less than less than 3 watts of power.

15. A light emitting diode module according to claim 1 which operates on operates on a total of about 2½ watts of power.

16. A light emitting diode module according to claim 1 wherein said at least one light emitting diode has an output in the range of about 25 to about 75 lumens each and wherein the module draws about 2½ watts of power when each of said at least one LED's is/are illuminated.

17. A light emitting diode module according to claim 1 wherein no component of the device extends upwardly above the upper-most points on the first and second contact members.

18. A festoon light system comprising a festoon type light fixture having at least one light emitting diode module according to claim 1 mounted therein.

* * * * *